United States Patent [19]

Konno et al.

[11] Patent Number: 4,632,708

[45] Date of Patent: Dec. 30, 1986

[54] ANNEALING SEPARATOR USED IN THE FINISHING ANNEALING STEP FOR PRODUCING A GRAIN-ORIENTED ELECTRICAL STEEL SHEET

[75] Inventors: Toyohiko Konno; Yozo Suga, both of Kitakyushu; Motoharu Nakamura, Himeji; Hajime Komatsu, Kawasaki, all of Japan

[73] Assignee: Nippon Steel Corporation, Tokyo, Japan

[21] Appl. No.: 848,296

[22] Filed: Apr. 4, 1986

[51] Int. Cl.[4] ..... H01F 1/04

[52] U.S. Cl. ..... 148/113; 148/27; 148/28; 501/96; 501/108

[58] Field of Search ..... 148/113, 27, 28; 501/96, 108

[56] References Cited

U.S. PATENT DOCUMENTS 3,941,622 3/1976 Lee et al. ..... 148/27

4,113,530 9/1978 Shimanaka et al. ..... 148/113

4,482,401 11/1984 Miller ..... 148/113

4,512,823 4/1985 Howe ..... 148/113

*Primary Examiner*—John P. Sheehan

*Attorney, Agent, or Firm*—Kenyon & Kenyon

[57] ABSTRACT

An annealing separator used in a finishing annealing step for producing a grain-oriented electrical steel sheet usually contains magnesia. The present invention is characterized by including, based on 100 parts by weight of magnesia, from 0.2 to 20 parts by weight of ferromanganese nitride or manganese nitride which consists of a composition $(Mn_{1-x}Fe_x)N_y$ having x and y values corresponding to A, B, C, and D and falling within a region surrounded by A, B, C, and D shown in the appended FIG. 1.

The annealing separator according to the present invention is effective for stabilizing secondary recrystallization and improving the properties of a forsterite film.

5 Claims, 6 Drawing Figures

ANNEALING SEPARATOR USED IN THE FINISHING ANNEALING STEP FOR PRODUCING A GRAIN-ORIENTED ELECTRICAL STEEL SHEET

BACKGROUND OF THE INVENTION

1. Field of the Invention

The present invention is related to an annealing separator used in the finishing annealing step of the producing process of a grain-oriented electrical steel sheet, and to a finishing annealing method for producing a grain-oriented electrical steel sheet. Particularly, the present invention is related to an annealing separator which satisfies conditions of both a stabilization of the secondary recrystallization in the finishing annealing and an improvement of the forsterite insulating film.

2. Description of the Related Arts

The conventional grain-oriented electrical steel sheet is a 0.10–0.35 mm thick steel sheet containing, usually, up to 4.5% by weight of Si, which is constituted, on the entire surface, by crystal grains having a (110)[001] orientation to the rolling direction (Goss oriented grains). The surface of the grain-oriented electrical steel sheet is usually covered with forsterite ($Mg_2SiO_4$), to ensure achievement of the insulative property. That is, the grain-oriented electrical steel sheet is a composite material composed of a silicon-containing electrical steel sheet having an extremely highly oriented (110)[001] texture (Goss texture) and a surfacial ceramic material of oxide-series, i.e., the forsterite. The surfacial ceramic material is thin, i.e., from 0.1 $\mu$m to a few microns in thickness.

An extremely high orientated Goss texture and a thin forsterite insulating film are heterogeneous to one another from the view point of material science. The achievement of such heterogeneous material is performed during a current production process for the grain-oriented electrical steel sheet, virtually simultaneously, in the single step of final annealing within an annealing box. To enhance the orientation of the Goss texture, a catastrophic grain growth (abnormal grain growth), referred to as secondary recrystallization, is industrially utilized. On the other hand, the forsterite film is formed by a solid-state reaction between the $SiO_2$, which is contained in the oxide film preliminarily formed on the surface of a steel sheet, and MgO, which is a major component of the annealing separator applied to the oxide layer. The secondary recrystallization and the forsterite formation are in essence, fundamentally different from one another. They are, however, liable to be equally influenced by the annealing atmosphere and any additive to the annealing separator, which is composed mainly of magnesia. The secondary recrystallization and the forsterite formation presumably proceed actually under a mutual interference therebetween at the interface of the interior of a steel sheet and surfacial part. From this point of view, much research has been carried out up to the present, regarding the annealing atmosphere and additives of the magnesia.

The weight of coils subjected to the final annealing is constantly increasing, towards an enhancement of the productivity. This inevitably leads to an enhancement of the temperature- and gas atmosphere-distribution along the length or width of the coils, and hence, to an enhancement of the nonhomogenity of the coil interior. The various compounds added to the annealing separator are useful for keeping the nonhomogenity of the coil interior to as low a level as possible. This has been a driving force behind the research into the additive compounds.

The additives of the annealing separator have two widely classified effects: A stabilization of the secondary recrystallization, and a stable formation of a forsterite film. In the former case, selection of the kind of additives is based on the criterion of which material mechanism induces the secondary recrystallization. In this regard, the presence of fine precipitates, referred to as the inhibitor, is indispensable for the secondary recrystallization; since the secondary recrystallization is usually stabilized by strengthening and maintaining the precipitation phases of the inhibitor up to a high temperature, and measures for stabilizing the secondary recrystallization are usually taken to ensure, in the annealing atmosphere, an adequate nitrogen partial pressure for the inhibitors composed mainly of nitrides and an adequate sulfur partial pressure for the inhibitors composed mainly of sulfides.

First, the prior art methods of ensuring an adequate nitrogen partial pressure are described. Japanese Examined Patent Publication No. 46-937 discloses that the annealing of an Al-containing silicon steel sheet in the nitrogen atmosphere is useful. This method was further developed as the method of Japanese Examined Patent Publication No. 46-40855, according to which various annealing methods of an Al, Ti, Zr, or V containing silicon steel are disclosed. Japanese Examined Patent Publication No. 49-6455 points out the utility of selectively nitriding the surface layer of an Al-containing silicon steel sheet. Japanese Examined Patent Publication No. 54-19850 proposes to adjust the dew point of the finishing annealing-atmosphere within a range of from −20° C. to +30° C., to attain an adequate absorption of nitrogen in the annealing atmosphere by the steel sheet. Japanese Examined Patent Publication No. 54-22408 proposes to carry out the finishing annealing in a nitrogen atmosphere containing 20% or less of hydrogen. Further, a metal nitride, specifically chromium nitride, titanium nitride, or vanadium nitride, is proposed in Japanese Examined Patent Publication No. 54-14568 as an additive for annealing separator, which allegedly lessens the dispersion of the annealing atmosphere along the width and length of a coil, by homogenizing the nitrogen partial pressure of the annealing atmosphere.

Second, the prior art methods of ensuring an adequate sulfur partial pressure are described. In this connection, Japanese Unexamined Patent Publication No. 53-50008 proposes, for the purpose of stabilizing the secondary recrystallization of silicon steels, in which the inhibitors composed mainly of Sb and S and/Se are utilized, to add a sulfur compound, such as $Fe_2S$, to the annealing separator or to carry out the finishing-annealing in a gas atmosphere containing $H_2S$.

As is apparent from the above description, the secondary recrystallization tends to be stabilizied by controlling the nitrogen or sulfur partial pressure in the finishing annealing. The additives of the annealing separator are used for stabilizing the nitrogen or sulfur partial pressure. The additives of the annealing separator are also used for stably forming a forsterite film. In order to facilitate the progress of solid state reaction between the MgO applied to the surface of a steel sheet and the $SiO_2$ preliminarily formed thereon, which results in the formation of forsterite ($Mg_2SiO_4$) as described above, an additive material having a catalystic action is usually advisable. For example, $MnO_2$ and $TiO_2$ are disclosed as the additives in Japanese Examined Patent Publication No. 51-12450, and Japanese Examined Patent Publication No. 51-12451, respectively. In addition, Japanese Examined Patent Publication No. 57-32716, Japanese Unexamined Patent Publication No. 55-89422, and Japanese Unexamined Patent Publication No. 56-75577 disclose that an Sr compound is effective for enhancing the properties of a forsterite film. It is to be noted that Japanese Unexamined Patent Publication No. 56-75577 allegedly eliminates, by means of a Sr compound, a defect of the film which incidentally arises due to the addition of a sulfide, such as $Fe_2S$, as proposed in Japanese Unexamined Patent Publication No. 53-50008, for stabilizing the secondary recrystallization. It is difficult to satisfy both the material properties and the interfacial properties, as can be understood from Japanese Unexamined Patent Publication No. 56-75577.

The development of additives for an annealing separator has been directed toward the stabilizing of the secondary recrystallization and the formation of a forsterite film, as described above, but does not necessarily attain the optimum properties. For example, in Japanese Examined Patent Publication No. 54-14568, the chromium nitride-, vanadium nitride-, and titanium nitride-additives relieve the nitrogen at a temperature influenced by the oxygen partial pressure, e.g., the dew point of the annealing atmosphere, but usually 900° C. or higher. This temperature lies in the proximity of the secondary recrystallization temperature. The steel can occasionally have a starting temperature for the secondary recrystallization lower than the nitrogen dissociation temperature. In this case, the secondary recrystallization may not be satisfactorily stabilized. Furthermore, the annealing separator should be improved in the light of forming an excellent forsterite film. As is known, the smaller the forsterite crystal grains constituting a forsterite film, the better become the mechanical properties, such as the adhesive property of a film. The $TiO_2$ addition disclosed in Japanese Examined Patent Publication No. 51-12451 is effective for promoting the solid state reaction of $MgO\text{-}SiO_2$ and the sintering of forsterite particles. Nevertheless, the grain size of a forsterite film obtained only by the addition of $TiO_2$ is approximately 1.0 μm and is not considered satisfactory. Subsequently, a method was disclosed in Japanese Unexamined Patent Publication No. 54-66935, in which the moisture and CaO quantities in the MgO powder are appropriately controlled, thereby obtaining a forsterite film having a fine average grain-size and an improved adhesive property. The forsterite particle size obtained by this method is 0.7 μm or less and is not necessarily satisfactory. Accordingly, the additive, which is effective for the $MgO\text{-}SiO_2$ solid state reaction, must be further developed. In addition, most of the additives developed to date, are strongly effective for only the secondary recrystallization or the forsterite film. Accordingly, one additive effective for the secondary recrystallization and another additive effective for the forsterite film must to be added, in a complex form, to the annealing separator. This is disclosed in Japanese Unexamined Patent Publication No. 53-50008 and Japanese Unexamined Patent Publication No. 56-75577. When the complex additives are used, a complicated operation is necessary for forming the magnesia into a slurry and thus the costs are increased.

SUMMARY OF THE INVENTION

It is an object of the present invention to provide a novel annealing separator containing an additive by a single compound, more effective, for both secondary recrystallization and formation of a forsterite film than the conventional additives.

The annealing separator according to the present invention is characterized by adding ferromanganese nitride- expressed by $(Mn_{1-x}Fe_x)N_y$ to the annealing separator composed mainly of magnesia. The ferromanganese nitride $(Mn_{1-x}Fe_x)N_y$ has a feature in that the nitrogen decomposition temperature, although dependent upon the Fe quantity (x amount), is from 600° C. to 900° C., i.e., is low; the nitrogen partial pressure rises even at the beginning stage of the finishing-annealing; and an effect of uniformizing the nitrogen partial pressure along the width of a coil is provided in a temperature range broader than heretofore possible. After the nitrogen release, the conversion of $Mn_{1-x}Fe_x$ to an oxide occurs to an extent depending upon the oxygen partial pressure, and hence, $Mn_{1-x}Fe_x$ contributes to a promotion of the formation reaction of forsterite from the beginning stage. In addition, the average particle diameter of forsterite becomes, for example, 0.5 μm or less, due to the addition of $(Mn_{1-x}Fe_x)N_y$, and, therefore, an excellent forsterite film having improved mechanical properties, such as adhesivity, can be obtained.

The present invention is hereinafter described in more detail.

DESCRIPTION OF THE PREFERRED EMBODIMENTS

The present invention is aimed at attaining a stable secondary recrystallization and a stable formation of a forsterite film by the provision of a single material. First, an explanation will be made of how an appropriate nitrogen partial pressure is ensured in the finishing annealing, to stabilize the secondary recrystallization.

The present inventors investigated in detail the decomposition temperature of $(Mn_{1-x}Fe_x)N_y$ using a differential thermal analysis (DTA) device. It was experimentally verified that the decomposition temperature of nitrogen drops with an increase in the Fe quantity (x value). This fact is evident from the Mn-N system phase diagram shown in M. HANSEN & K. ANDERKO, Constitution of Binary Alloys, 2nd ed. McGrow Hill (1958) P. 935, and Fe-N system phase diagram (ditto P. 670), and from the metallurgical data of given by Kubaschewski & C. B. Alcock, in Metallurgical Thermochemistry, 5th ed. Pergamon Press (1979) P. 294 and P. 284.

Table 1 gives the temperature of the dissociation of nitrogen in an Ar atmosphere, obtained in an experiment by the inventors.

TABLE 1

| | | | | |
|---|---|---|---|---|
| x | 0 | 0.15 | 0.30 | 1 |
| y | 0.30 | 0.25 | 0.25 | 0.25 |
| Nitrogen-dissociation temperature (°C.) | 870 | 790 | 700 | 630 |

Figure 1:
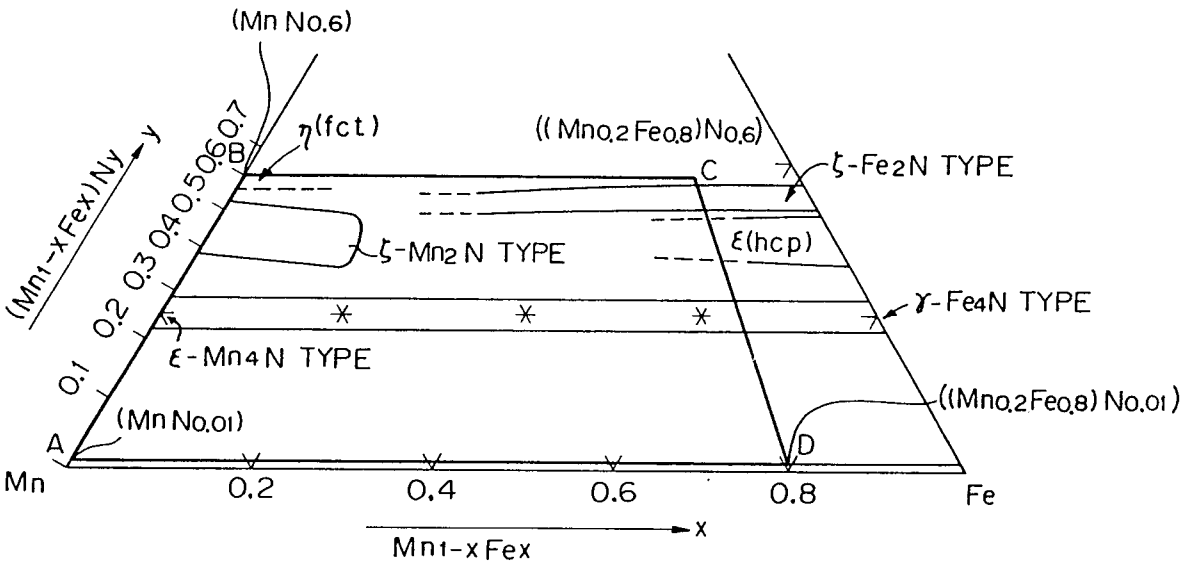
FIG. 1 is a provisional ternary phase diagram of Mn-Fe-N at room temperature, wherein the region surrounded by the thick lines ABCD shows the composition range of Mn, Fe and N claimed in the present invention.

X-ray diffraction was then carried out, and the results thereof compared with existing data of the Mn-N system and Fe-N system (e.g., ASTM cards: 31-824, 6-0627, 6-0656, and the like), to investigate the crystal structure of $(Mn_{1-x}Fe_x)N_y$ having various x and y values. FIG. 1 shows the results of the investigation, by an equilibrium phase diagram, of the Mn-Fe-N system in which the phases of $(Mn_{1-x}Fe_x)N_y$ presumably present are set forth. As illustrated in this phase diagram of FIG. 1, the X-ray diffraction method reveals that when y is in the range of from 0.4 to 0.5 ($0.4 \leqq y \leqq 0.5$) and when x is increased from 0.15 to 0.3, the $(Mn_{1-x}Fe_x)N_y$ phase changes from a hexagonal $\zeta$-$Mn_{2.3}N$ single phase to dual phases of rhombic $\zeta$-$Fe_2N$ and face centered cubic $\gamma$-$Fe_4N$. This proves a part of the phase-equilibrium theory that the hexagonal $\zeta$-$Mn_{2.3}N$ structure is not very stable if a replacement with Fe is carried out, and is decomposed into two phases of $\zeta$-$Fe_2N$ and $\gamma$-$Fe_4N$ types by the replacement of 30% of Mn atoms with Fe. Such changes in the crystal structure also indicate a change in the stability of nitride and appears to conform to a decrease in the nitrogen dissociating temperature of close to 100° C. in accordance with the change of x from 0.15 to 0.3.

From the experimental results of thermal analysis, X-ray diffraction and the thermal analytical- and phase equilibrium- considerations, it was elucidated that, by changing the x value and hence the composition of $(Mn_{1-x}Fe_x)N_y$, the decomposition temperature thereof can be relatively freely changed within a temperature range of from 600° C. to 900° C.

Figure 2:
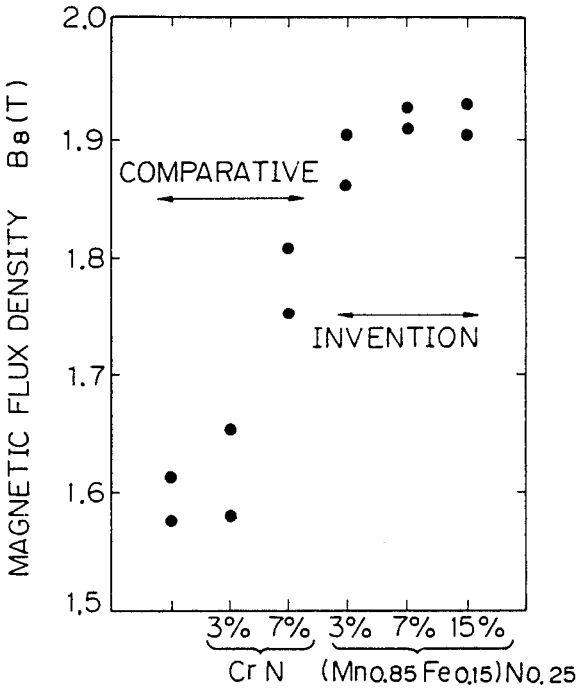
FIG. 2 is a graph showing the magnetic flux density $B_8$ obtained when CrN or $(Mn_{1-x}Fe_x)N_y$ is added to magnesia.

In order to confirm the effects of $(Mn_{1-x}Fe_x)N_y$, the powder of nitride having x=0.15 and y=0.25 was mixed with magnesia powder at weight ratio of from 3 to 15 parts and was applied in the form of a slurry to the decarburization-annealed, primary-recrystallized silicon steel sheet, and then the finishing annealing was carried out. For comparison the magnesia powder with an additive of CrN and without an additive were used for the identical silicon steel sheet. As is apparent from FIG. 2, the secondary recrystallization is stabilized and the magnetic flux density $B_8 > 1.90(T)$ is obtained when $(Mn_{1-x}Fe_x)N_y$ is added to the magnesia powder.

Figure 3:
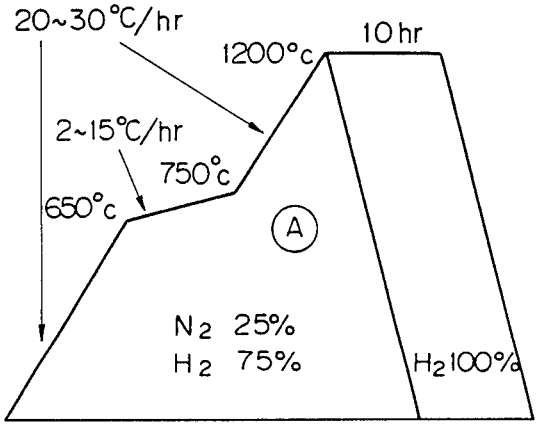
FIG. 3 illustrates an example of the annealing cycle according to the present invention; and, FIGS. 4A through 4C show two-step replica photographs of forsterite film, where 4B is obtained when CrN is added to magnesia and 4C is obtained when $(Mn_{1-x}Fe_x)N_y$ is added.
Figure 3:
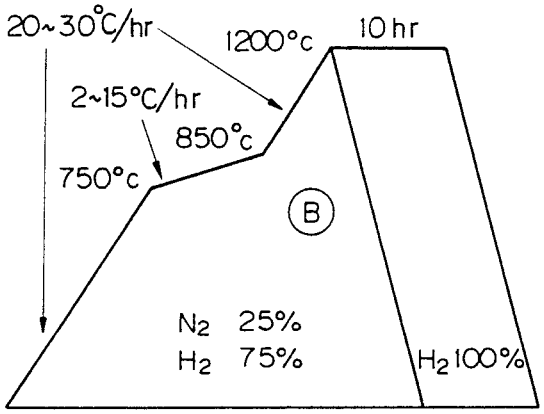

Next, in order to observe how and whether ferromanganese nitride is effective for mitigating the anticipated, dispersive conditions of the finishing annealing, such as the difference in the temperature-elevating rates at portions of a coil, $(Mn_{1-x}Fe_x)N_y$ was added to the MgO powder and the finishing annealing was carried out by employing various temperature-elevating patterns. Representative annealing cycles are shown in FIG. 3, as "A" and "B". Table 2, below, shows the x and y values of $(Mn_{1-x}Fe_x)N_y$ and $B_8$ obtained by the annealing cycles A and B.

TABLE 2

| | | $B_8$(T) at additive of $(Mn_{1-x}Fe_x)N_y$ | | | | |
|---|---|---|---|---|---|---|
| Composition | x | 0 | 0.15 | 0.30 | 0.50 | 1 |
| | y | 0.30 | 0.25 | 0.25 | 0.25 | 0.25 |
| Annealing Cycle | A | 1.90(T) | 1.91(T) | 1.94(T) | 1.93(T) | 1.62(T) |
| | B | 1.93(T) | 1.93(T) | 1.91(T) | 1.89(T) | 1.63(T) |

As is apparent from Table 2, an optimum value of the x value varies, depending upon the annealing cycle. This is readily understood from the fact that the nitrogen dissociation temperature is dependent upon the Fe content (x value) of the ferromanganese nitride. A temperature difference in the large sized coils allegedly amounts to 100° C. to 200° C. in the finishing annealing. Even for such large sized coils, magnetic properties uniform along width and length of the coils can be obtained, when $(Mn_{1-x}Fe_x)N_y$ powders having various x values are mixed with each other and added to magnesia.

Next, the effects of $(Mn_{1-x}Fe_x)N_y$ upon the forsterite film are described.

Figure 4A:
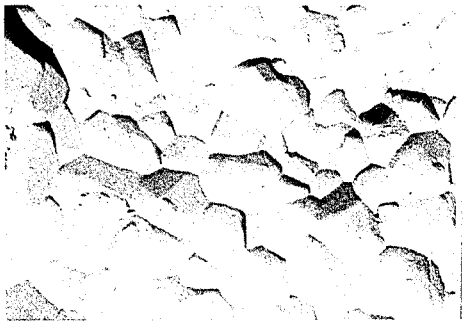
Figure 4B:
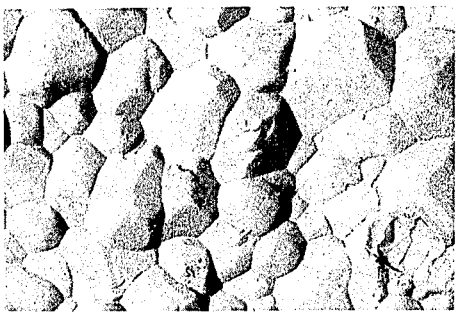
Figure 4C:
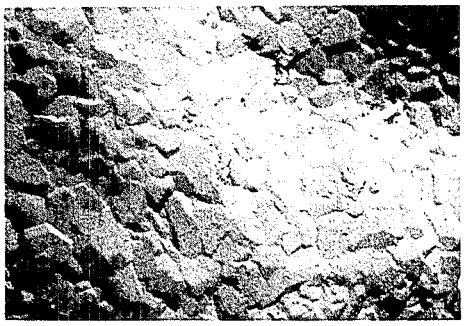

Referring to FIGS. 4A, 4B and 4C, the transparent type electron microscope photographs of the forsterite films by the two step replica method are shown. The forsterite film shown in FIG. 4C was formed by finishing annealing using the magnesia powder with 7 parts by weight of an additive $(Mn_{1-x}Fe_x)N_y$ (x=0.15, y=0.25); the forsterite film shown in FIG. 4A of the comparative example was formed without an additive; and the forsterite film shown in FIG. 4B was formed with 7 parts by weight of CrN. As is apparent from FIG. 4, the average particle diameter of forsterite 0.5 μm or less is obtained by the addition of $(Mn_{1-x}Fe_x)N_y$. The effect such as a refining of the forsterite particles of the $(Mn_{1-x}Fe_x)N_y$ appears to be attributable to the conversion of this material into the $Mn_{1-x}Fe_x$-oxide, occurring after the nitrogen dissociation. Regarding the conversion to oxide, the following considerations are made. The dew point of the annealing atmosphere of finishing annealing is usually from approximately −40° C. to −10° C. This annealing atmosphere is sufficiently oxidizing for Mn. The following reaction may therefore occur.

$$(Mn_{1-x}Fe_x)N_y + \tfrac{1}{2}O_2 \rightarrow (Mn_{1-x}Fe)O + yN$$

It is reasonable to consider, from the thermodynamical data (Kubaschewski et al, ditto page 294) that the form of the resultant $(Mn_{1-x}Fe_x)O$ is a complex oxide having the lowest order.

The $(Mn_{1-x}Fe_x)O$ described above appears to behave catalystically for the $MgO$-$SiO_2$ solid phase reaction when this reaction begins at approximately 900° C., with the result that the crystal grains of the forsterite film are refined.

The strength of a forsterite film was investigated by the bending peel test, with regard to the annealing separators with or without additives. The results are shown in Table 3.

TABLE 3

| | | | |
|---|---|---|---|
| Additive (Metal Nitride) | None | 7% CrN | 7% $(Mn_{1-x}Fe_x)N_y$ |
| Minimum Peel Diameter | 20 mmϕ | 20 mmϕ | 5 mmϕ |
| Remarks | | Comparative | Invention |

As is apparent from the results given in Table 3, the minimum peel diameter of 5 mmϕ is obtained for the annealing separator with the $(Mn_{1-x}Fe_x)N_y$ additive, and this indicates that the strength of this forsterite film is superior to that of the ordinary forsterite films.

As described hereinabove, when the finishing annealing step for producing a grain-oriented electrical steel sheet is carried out after applying, on the decarburization-annealed steel sheet, the annealing separator mainly composed of MgO and additionally containing $(Mn_{1-x}Fe_x)N_y$, (1) the secondary recrystallization is stabilized due to an enhancement and homogenization of the nitrogen partial pressure within the annealing atmosphere, and (2), the forsterite-cyrstal grain diameter of the forsterite film is reduced to 0.5 μm or less due to the formation of $(Mn_{1-x}Fe_x)$-oxides after the nitrogen dissociation from $(Mn_{1-x}Fe_x)N_y$, thereby improving both the mechanical and magnetic properties.

The composition of $(Mn_{1-x}Fe_x)N_y$ is hereinafter described. When the Fe content in terms of x exceeds 0.8 ($x>0.8$), the dissociation temperature of nitrogen is too low to ensure the nitrogen partial pressure during the finishing annealing. The $(Mn_{1-x}Fe_x)N_y$ wherein $x=0$, i.e., pure manganese nitride, is effective for stabilizing the secondary recrystallization. The x value is therefore from 0 to 0.8 ($0 \leqq x \leqq 0.8$).

The "y" value determines the nitrogen content. At $y<0.01$, as is apparent from the phase diagram, the constituent phase of $(Mn_{1-x}Fe_x)N_y$ is virtually an entirely primary (Mn, Fe) solid solution in which the N is solute. In this case, the requisite partial pressure cannot be maintained, and the dissociation temperature is too low to practically use the above solution as an additive of the annealing separator. The $(Mn_{1-x}Fe_x)N_y$ wherein $y \geqq 0.6$ can be prepared only with difficulty, and the presence thereof under ambient pressure cannot be identified. Note, the thermodynamical experimental results described hereinabove reveal that at least three phases of the $\zeta$-$Mn_{2.3}N$ type: $\zeta$-$Fe_2N$ type, and $\gamma$-$Fe_4N$ type crystal structures are present at room temperature in the Mn-Fe-N systems, and further stoichiometric $\zeta$-$Mn_{2.3}N$, $\zeta$-$Fe_2N$ and $\gamma$-$Fe_4N$ are formed at $y=0.43$, 0.50, and 0.25, respectively, although nonstoichiometric phases are still formed at slight deviations from these y values. Accordingly, the $(Mn_{1-x}Fe_x)N_y$ ($0.01 \leqq y<0.6$) can be most generally expressed as a mixture of a primary (Mn, Fe)-N solid solution and any one of above mentioned three phases.

From the considerations described above, $(Mn_{1-x}Fe_x)N_y$ limited to the range A, B, C, and D, as shown in FIG. 1, is used in the present invention. The commercially available ferromanganese nitride of under 325 mesh used for the N addition during the steelmaking of stainless steels can be used as the $(Mn_{1-x}Fe_x)N_y$ in the present invention. The ferromanganese nitride mentioned above may be sieved to obtain the finer particles to be used in the present invention.

The $(Mn_{1-x}Fe_x)N_y$ to be added to the annealing separator, in the form of a particulate powder, can attain the effects of present invention, without depending upon the particle size. The particle size of $(Mn_{1-x}Fe_x)N_y$ is therefore not specifically limited. However, when the particle size is very large, the metal nitride precipitates during stirring for making the annealing separator into a slurry. The particle size is, therefore, preferably under 325 mesh (44 μm or less according to the JIS nominal diameter).

The content of $(Mn_{1-x}Fe_x)N_y$ based on magnesia, which is the base component of the annealing separator, is from 0.2 part to 20 parts by weight based on 100 parts by weight of MgO. At a content of less than 0.2 part by weight, the effects of $(Mn_{1-x}Fe_x)N_y$ are not appreciable. On the other hand, at a content of more than 20 parts by weight, the effects of $(Mn_{1-x}Fe_x)N_y$ virtually are not enhanced, and hence, the addition of such a high content is economically insignificant. The preferred content is from 3 to 8 parts by weight.

As described above, the nitrogen dissociation temperature can be adjusted by changing the x value of $(Mn_{1-}Fe_x)N_y$. When at least two $(Mn_{1-x}Fe_x)N_y$ mixtures having different x values are mixed with one another and added to the annealing separator, their effects for homogenizing the nitrogen partial pressure within the coil are outstanding. Also in this case, the content of $(Mn_{1-x}Fe_x)N_y$ based on 100 parts by weight of MgO is from 0.2 to 20 parts by weight.

The $(Mn_{1-x}Fe_x)N_y$ according to the present invention can be mixed with a known additive, such as a boron compound, $TiO_2$, various sulfates, and or metal nitrides, such as chromium nitride, and may be added to the annealing separator. Even in this case, the effects of $(Mn_{1-x}Fe_x)N_y$ can be realized satisfactorily and independently from the effects of the known additive(s).

The steels to be finishing-annealed with the annealing separator according to the present invention are not limited, since the ferromanganese added to the annealing separator is effective for improving the magnetic properties and the forsterite film, no matter what kinds of steels are finishing annealed in the step for producing a grain-oriented electrical steel sheet. The effect of $(Mn_{1-x}Fe_x)N_y$, particularly stabilization of the magnetic properties, are, however, particularly outstanding for steels having a composition series such that the secondary recrystallization is attained by utilizing the AlN based inhibitor. The $(Mn_{1-x}Fe_x)N_y$ is equally effective for improving the forsterite film for any steels, independently of the composition series, since the forsterite-formation reaction is a solid phase $MgO$-$SiO_2$ reaction for any composition series.

The present invention is hereinafter explained by way of examples.

EXAMPLE 1

A hot-rolled strip containing 0.050% of C, 3.20% of Si, 0.16% of Mn, 0.01% of S, 0.03% of Al, and 0.007% of N was annealed at 1120° C. for 2 minutes, cold-rolled to obtain a thickness of 0.30 mm and then decarburized at 830° C. for 3 minutes in wet hydrogen.

$(Mn_{1-x}Fe_x)N_y$ or chromium nitride was added to the annealing separator, the main components of which were 100% by weight of MgO and 4 parts by weight of $TiO_2$. The suspension liquid in a slurry form was prepared, applied to a decarburized sheet, and then dried. Each coil to which the additive was applied was a 10 ton-coil having a width of 1030 mm and an inner diameter of 20 inches. The coils were finishing-annealed at 1200° C. for 20 hours in a 25% $N_2$ +75% $H_2$ atmosphere. The results are given in Table 4.

TABLE 4

| Additive | Coil Top | | | Coil Middle | | | Coil Bottom | | |
|---|---|---|---|---|---|---|---|---|---|
| | $B_8$ (T) | $W_{17/50}$ (W/Kg) | Particle size of forsterite (μm) | $B_8$ (T) | $W_{17/50}$ (W/Kg) | Particle size of forsterite (μm) | $B_8$ (T) | $W_{17/50}$ (W/Kg) | Particle size of forsterite (μm) |
| None (Comparative) | 1.858 | 1.42 | 1.1 | 1.847 | 1.56 | 1.0 | 1.840 | 1.55 | 1.0 |
| 1% Chromium nitride (Comparative) | 1.872 | 1.20 | 0.9 | 1.859 | 1.33 | 1.0 | 1.883 | 1.23 | 1.1 |
| 5% Chromium nitride (Comparative) | 1.889 | 1.20 | 0.9 | 1.873 | 1.25 | 0.8 | 1.891 | 1.15 | 0.9 |
| 15% Chromium nitride (Comparative) | 1.895 | 1.18 | 1.0 | 1.868 | 1.28 | 1.0 | 1.893 | 1.20 | 0.7 |
| 1% $Mn_{0.85}Fe_{0.15}N_{0.25}$ (Invention) | 1.901 | 1.13 | 0.4 | 1.908 | 1.11 | 0.4 | 1.879 | 1.18 | 0.4 |
| 5% $Mn_{0.85}Fe_{0.15}N_{0.25}$ (Invention) | 1.931 | 1.04 | 0.3 | 1.932 | 1.03 | 0.4 | 1.929 | 1.06 | 0.4 |
| 15% $Mn_{0.85}Fe_{0.15}N_{0.25}$ (Invention) | 1.925 | 1.08 | 0.3 | 1.929 | 1.07 | 0.3 | 1.928 | 1.05 | 0.4 |

As is apparent from Table 4, the addition of $(Mn_{1-x}Fe_x)N_y$ (x=0.15, y=0.25), achieves a stable secondary recrystallization along the width of the coils and the forsterite-grain diameter of the surface film is refined, and further, the magnetic properties are generally improved.

EXAMPLE 2

A hot-rolled strip containing 0.055% of C, 3.35% of Si, 0.20% of Mn, 0.003% of S, 0.03% of Al, and 0.007% of N was annealed at 1150° C. for 2 minutes, cold-rolled to obtain a thickness of 0.23 mm, and then decarburized at 870° C. for 3 minutes in wet hydrogen.

One or two $(Mn_{1-x}Fe_x)N_y$ compounds, chromium nitride alone, or both the $(Mn_{1-x}Fe_x)N_y$ and chromium nitride were added to the annealing separator, the main component of which was MgO. The suspension liquid in a slurry form was prepared, applied to a decarburized sheet, and then dried. Each coil to which the additive was applied was a 10-ton-coil having a width of 1030 mm and an inner diameter of 20 inches. The coils were finishing-annealed at 1160° C. for 20 hours in a 25% $N_2$+75% $H_2$ atmosphere. The results are given in Table 5.

TABLE 5

| Additive | Coil Top | | | Coil Middle | | | Coil Bottom | | |
|---|---|---|---|---|---|---|---|---|---|
| | $B_8$ (T) | $W_{17/50}$ (W/Kg) | Particle size of forsterite (μm) | $B_8$ (T) | $W_{17/50}$ (W/Kg) | Particle size of forsterite (μm) | $B_8$ (T) | $W_{17/50}$ (W/Kg) | Particle size of forsterite (μm) |
| 5% Chromium nitride (Comparative) | 1.853 | 1.38 | 0.9 | 1.867 | 1.42 | 0.8 | 1.866 | 1.42 | 0.8 |
| 5% (A) (Invention) | 1.933 | 0.97 | 0.3 | 1.929 | 0.97 | 0.4 | 1.931 | 0.95 | 0.4 |
| 5% (B) (Invention) | 1.939 | 0.99 | 0.4 | 1.939 | 0.96 | 0.3 | 1.941 | 0.98 | 0.3 |
| 5% Chromium nitride + 5% (A) (Invention) | 1.942 | 0.96 | 0.3 | 1.938 | 0.95 | 0.4 | 1.937 | 0.96 | 0.4 |
| 5% Chromium nitride + 5% (B) (Invention) | 1.932 | 0.97 | 0.3 | 1.925 | 0.99 | 0.4 | 1.931 | 0.98 | 0.3 |
| 5% (A) + 5% (B) (Invention) | 1.937 | 0.94 | 0.3 | 1.938 | 0.97 | 0.3 | 1.935 | 0.96 | 0.3 |
| 8% (A) + 8% (B) (Invention) | 1.941 | 0.93 | 0.3 | 1.940 | 0.96 | 0.3 | 1.938 | 0.94 | 0.3 |

Remarks:
$(Mn_{1-x}Fex)Ny$ (A) x = 0.15 y = 0.30
$(Mn_{1-x}Fex)Ny$ (B) x = 0.30 y = 0.30

As is apparent from Table 5, when $(Mn_{1-x}Fe_x)N_y$ compounds having different x and y values and added to the annealing separator are mixed with one another, or when one $(Mn_{1-x}Fe_x)N_y$ compound is mixed with chromium nitride and is added to the annealing separator, uniform magnetic properties along the width of coils are obtained, and the properties of forsterite film are improved.

EXAMPLE 3

A hot-rolled strip containing 0.065% of C, 3.35% of Si, 0.10% of Mn, 0.024% of S, 0.03% of Al, and 0.008% of N was annealed at 1150° C. for 2 minutes, cold-rolled to obtain a thickness of 0.20 mm, and then decarburized at 830° C. for 1 minute and 30 second in wet hydrogen.

$(Mn_{1-x}Fe_x)N_y$ (x=0.20, y=0.25) was added to annealing separator, the main component of which was MgO. The suspension liquid in a slurry form was prepared, applied on a decarburized sheet, and then dried. The sheets were finishing-annealed at 1200° C. for 20 hours in an Ar atmosphere. The results are given in Table 6.

TABLE 6

| Additive | $B_8$ | $W_{17/50}$ | Particle size of forsterite | Minimum peel diameter |
|---|---|---|---|---|
| None (Comparative) | 1.852 (T) | 1.18 (W/Kg) | 1.1 (μm) | 12 (mm) |
| 5% Chromium nitride (Comparative) | 1.886 | 1.03 | 0.9 | 10 |
| 1% $(Mn_{0.85}Fe_{0.15})N_{0.25}$ (Invention) | 1.910 | 0.91 | 0.4 | 4 |
| 5% (Invention) | 1.923 | 0.86 | 0.4 | 5 |
| 10% (Invention) | 1.921 | 0.88 | 0.3 | 3 |

EXAMPLE4

The hot-rolled strip of Example 3 was annealed at 1120° C. for 2 minutes, cold-rolled to obtain a thickness of 0.30 mm, and then decarburized at 830° C. for 3 minutes in wet hydrogen.

$(Mn_{1-x}Fe_x)N_y$ (x=0.30, y=0.25) was added to the annealing separator, the main components of which were 100% by weight of MgO and 5 parts by weight of $TiO_2$. The suspension liquid in a slurry form was prepared, applied to a decarburized sheet, and dried. The coils were finishing annealed at 1210° C. for 20 hours in a 50% $N_2$+50% $H_2$ atmosphere and $N_2$ atmosphere. The results are given in Table 7.

TABLE 7

| Additive | $H_2$ | | | 50% $H_2$ + 50% $N_2$ | | | $N_2$ | | |
|---|---|---|---|---|---|---|---|---|---|
| | $B_8$ (T) | $W_{17/50}$ (W/Kg) | Particle size of forsterite (μm) | $B_8$ (T) | $W_{17/50}$ (W/Kg) | Particle size of forsterite (μm) | $B_8$ (T) | $W_{17/50}$ (W/Kg) | Particle size of forsterite (μm) |
| None (Comparative) | 1.882 | 1.14 | 0.9 | 1.896 | 1.13 | 0.8 | 1.877 | 1.19 | 0.9 |
| 5% Chromium nitride (Comparative) | 1.906 | 1.10 | 1.0 | 1.902 | 1.11 | 0.8 | 1.891 | 1.13 | 0.9 |
| 3% $Mn_{0.7}Fe_{0.3}N_{0.3}$ (Invention) | 1.917 | 1.08 | 0.5 | 1.937 | 0.97 | 0.3 | 1.913 | 1.08 | 0.4 |
| 8% $Mn_{0.7}Fe_{0.3}N_{0.3}$ (Invention) | 1.925 | 0.99 | 0.4 | 1.941 | 0.95 | 0.3 | 1.918 | 1.04 | 0.4 |

We claim:

1. An annealing separator used in a finishing-annealing step for producing a grain-oriented electrical steel sheet, containing magnesia, characterized by including, based on 100 parts by weight of said magnesia, from 0.2 to 20 parts by weight of ferromanganese nitride or manganese nitride which consists of a composition $(Mn_{1-x}Fe_x)N_y$ having x and y values corresponding to A, B, C and D, and falling within a region surrounded by A, B, C and D shown in the appended FIG. 1.

2. An annealing separator according to claim 1, wherein at least two compositions $(Mn_{1-x}Fe_x)N_y$ having different x and y values are included.

3. A finishing annealing method for producing a grain-oriented electrical steel sheet, wherein an annealing separator containing magnesia is applied to a cold-rolled and then decarburized annealed sheet, and then said sheet is annealed to generate secondary recrystallization and to form a forsterite film thereon, characterized by including, based on 100 parts by weight of said magnesia, from 0.2 to 20 parts by weight of ferromanganese nitride or manganese nitride which consists of a composition $(Mn_{1-x}Fe_x)N_y$ having x and y values corresponding to A, B, C, and D and falling within a region surrounded by A, B, C, and D shown in the appended FIG. 1.

4. Annealing separator according to claim 3, wherein at least two compositions $(Mn_{1-x}Fe_x)N_y$ having x and y values different from one another are included.

5. A method according to claim 3 or 4, wherein said sheet is finishing-annealed in the form of a coil.

* * * * *